US006093088A

United States Patent [19]

Mitsuhashi et al.

[11] Patent Number: 6,093,088

[45] Date of Patent: Jul. 25, 2000

[54] SURFACE POLISHING MACHINE

[75] Inventors: Masashige Mitsuhashi; Kenichi Ohno, both of Tokyo, Japan

[73] Assignee: NEC Corporation, Tokyo, Japan

[21] Appl. No.: 09/340,184

[22] Filed: Jun. 28, 1999

[30] Foreign Application Priority Data

Jun. 30, 1998 [JP] Japan ..... 10-183114
Feb. 26, 1999 [JP] Japan ..... 11-050192

[51] Int. Cl.[7] ..... B24B 49/00

[52] U.S. Cl. ..... 451/285; 451/287; 451/288; 451/443

[58] Field of Search ..... 451/41, 56, 285, 451/287, 288, 443, 456

[56] References Cited

U.S. PATENT DOCUMENTS

| | | | |
|---|---|---|---|
| 5,433,650 | 7/1995 | Winebarger | 451/41 |
| 5,456,627 | 10/1995 | Jackson et al. | 451/67 |
| 5,584,749 | 12/1996 | Mitsuhashi et al. | 451/285 |
| 5,645,469 | 7/1997 | Burke et al. | 451/41 |
| 5,649,849 | 7/1997 | Pileri et al. | 451/285 |
| 5,664,990 | 9/1997 | Adams et al. | 451/41 |
| 5,779,526 | 7/1998 | Gill | 451/56 |
| 5,785,585 | 7/1998 | Manfredi et al. | 451/56 |

FOREIGN PATENT DOCUMENTS

| | | |
|---|---|---|
| S48-5956 | 2/1973 | Japan . |
| S50-48593 | 4/1975 | Japan . |
| S61-297073 | 12/1986 | Japan . |
| S62-44370 | 2/1987 | Japan . |
| S63-21557 | 2/1988 | Japan . |
| H1-127265 | 5/1989 | Japan . |
| 4-33336 | 2/1992 | Japan . |
| H4-75870 | 3/1992 | Japan . |
| 5-69310 | 3/1993 | Japan . |
| 5-309559 | 11/1993 | Japan . |
| H6-39705 | 2/1994 | Japan . |
| 7-130688 | 5/1995 | Japan . |
| H7-251371 | 10/1995 | Japan . |
| H8-281551 | 10/1996 | Japan . |
| H8-309659 | 11/1996 | Japan . |
| H10-58315 | 1/1997 | Japan . |
| H9-11117 | 1/1997 | Japan . |
| H9-36071 | 2/1997 | Japan . |

*Primary Examiner*—Eileen P. Morgan
*Attorney, Agent, or Firm*—Sughrue, Mion, Zinn, Macpeak & Seas PLLC

[57] ABSTRACT

A surface polishing machine includes a polishing tool having a polishing tool face, a pressurizing member, placed on and movable in unison with a workpiece placed on the annular polishing tool, for pressurizing the workpiece toward the polishing tool, and a polishing-position retaining mechanism for holding the workpiece at a predetermined polishing position by preventing it from moving in unison with the polishing tool, while permitting it to rotate, as the polishing tool rotates. To reduce the overall size of the polishing machine and carry out highly accurate polishing, the polishing tool has its diameter larger than the diameter of the workpiece and smaller than twice the workpiece diameter. Alternatively, the polishing tool face is formed with an annular groove coaxially with the center of rotation of the polishing tool so that the annular groove extends to pass through the center of rotation of the workpiece placed on the polishing tool.

19 Claims, 7 Drawing Sheets

SURFACE POLISHING MACHINE

BACKGROUND OF THE INVENTION

1. Technical Field

The present invention relates to a surface polishing machine, and more particularly to, a surface polishing machine for machining a highly flat surface on disk-shaped workpieces such as semiconductor wafers, wafers mounted with semiconductor circuits, and magnetic disks, or plate-like workpieces such as glass substrates.

2. Related Arts

In conventional surface polishing implemented by a rotating an annular polishing tool, the size of a workpiece is naturally limited. Specifically, the polishing can be accomplished only for such a workpiece having a diameter smaller than a radial width of an annular polishing tool face of the polishing tool, the radial width being measured as the distance between two points located on the same diametral line of and crossing the inner and outer peripheries of the annular polishing tool face, respectively.

In a conventional arrangement exemplarily shown in FIGS. 6 and 7, an annular polishing tool 102 having a predetermined thickness is placed on a turntable 101. The outer diameter D0 of the annular polishing tool 102 is the same as that of the turntable. Symbol d0 denotes the inner diameter of the annular polishing tool 101, i.e., the diameter of a central through hole formed therein. Symbol W denotes the radial width of the annular polishing tool face 102A of the polishing tool 102. In the arrangement shown in FIG. 7, the polishing tool face width W is represented by equation W=(D0−d0)/2.

Reference numeral 100 represents a disk-shaped workpiece placed on the polishing face 102A. This disciform workpiece 100, serving as an object of polishing, must have its diameter D1 smaller than the width W of the annular polishing tool face of the polishing tool 102.

The workpiece 100 is always kept pressed toward the annular polishing tool 102 by a pressure holding plate 201 having the same diameter as that of the workpiece, whereby the workpiece is always applied with an appropriate pressurizing force during the polishing. In this example of FIGS. 6 and 7, the plate 201 has the same diameter K0 as that of the workpiece 100.

The pressure holding plate 201 is permitted to rotate and move in unison with the workpiece 100, while pressurizing the workpiece 100 toward the polishing tool 102, as the polishing tool 102 rotates. Reference numeral 202 denotes a polishing-position retaining mechanism for setting the pressure holding plate 201 and the workpiece 100 at a predetermined position on the polishing tool face 102A and for retaining them at that position.

Upon start of polishing of the workpiece 100, the turntable 101 is driven by a drive motor, not shown, and rotates in the direction of arrow R. Thus, the workpiece 100 placed on the polishing tool face 102A attempts to make a rotary motion in unison with the polishing tool 102 but is retained at the position shown in FIG. 7 since such a rotary motion is prohibited by the polishing-position retaining mechanism 202.

At the same time, due to a difference between the peripheral velocities of the polishing tool 102 on the inner- and outer-peripheral sides, the workpiece rotates around its axis on the polishing tool face 102A in the direction of arrow C shown in FIG. 7, while being pressed by the pressure holding plate 201. For this reason, an abrading action occurs between the workpiece and the polishing tool face 102A, whereby the workpiece 100 is polished uniformly accurately by the polishing tool 102.

As the number of times of usage of the polishing tool increases, the polishing tool is wear out, and irregularities and surface roughening of the tool are caused. In this respect, attempts have been made to make dressing with use of a dresser to remove constituent material of the polishing tool from its face, to create a smooth polishing tool face, so that the polishing with adequate evenness or flatness may be achieved.

As disclosed in Japanese patent KOKAI publication no. 7-130688, another attempt is made to alternately repeatedly carry out polishing and washing processes to ensure that the polishing is always done in a clean condition.

During polishing, moreover, abrasive fluid is normally supplied to the polishing tool face by dropping the same on part of the polishing tool face or by spraying it over the entirety thereof.

In the above-mentioned prior art example, the workpiece is required to have a diameter K0 smaller than the radial width W of the annular polishing tool face 102A of the polishing tool 102. Thus, the prior art entails a drawback that the annular polishing tool 102 becomes significantly large in diameter, as the diameter of the disciform workpiece 100 becomes larger.

If the polishing is carried out in a state where the workpiece 100 is retained at substantially the same position on the polishing tool, the polishing is accomplished by using only a corresponding part of the polishing tool face. In this case, the polishing tool face is susceptible to scratching at that part.

In case that a disk-shaped dresser is utilized to create a flat polishing tool face so as to carry out the surface polishing with satisfactory evenness, a problem is caused such that only part of the polishing tool face 102A can be stripped off since the diameter of the disk-shaped dresser is, in most cases, smaller than the width of the polishing tool face.

As mentioned above, the disciform workpiece 100 is sometimes subject to polishing and washing processes which are alternately repeatedly done with the intention of always implementing the polishing in a clean condition. However, this technique entails a problem that an increased number of steps are required and much time is needed for the polishing.

If the abrasive fluid is dropped on part of the polishing tool face 102A or if it is sprayed over the entirety of the tool face, the abrasive fluid tends to congregate at part of the tool face or to be dispersed to the surroundings of the tool face or dispersed into the atmospheric air. This prevents efficient supply of the abrasive fluid to the tool face.

Another type of surface polishing machine is also known in which the polishing of semiconductor wafers, magnetic disks, or the like is implemented with use of a disciform polishing tool instead of an annular polishing tool, as described in Japanese patent KOKAI publication nos. 4-33336, 5-69310, and 5-309559.

As exemplarily shown in FIG. 11, a conventional surface polishing machine of this type is provided with a disciform polishing tool 541 adapted to be rotatively driven and having a machining face thereof directed upward. For the surface polishing, a workpiece 542 is in contact with the upper face (polishing tool face) of the polishing tool 541 under pressure of a pressure holding plate 543 while abrasive fluid 544 is supplied to the polishing tool face.

The above-mentioned conventional polishing machine poses a problem that the evenness in workpiece thickness becomes worsened since an amount of removal of material at an inner peripheral portion of the workpiece is smaller than that removed at an outer peripheral portion thereof, so that the inner peripheral portion becomes thicker than the outer peripheral portion, as shown in FIG. 12. This problem is caused by two major factors: First, the abrasive fluid flowing into a central part of the machined face of the workpiece is insufficient in quantity, and secondly, a central part of polishing tool face, which is in contact with a center part of the workpiece face, is subject to significant wear and gouge, as compared to other portions of the polishing tool face.

SUMMARY OF THE INVENTION

An object of the present invention to provide a surface polishing machine having a reduced overall size, while capable of implementing highly accurate polishing.

Another object of the present invention is to provide a surface polishing machine capable of polishing a large diameter workpiece with excellent evenness or flatness.

According to one aspect of the present invention, a surface polishing machine is provided, which comprises an annular polishing tool having an annular polishing tool face and adapted to be rotatively driven; a disciform pressurizing member, placed on and movable in unison with a workpiece placed on the annular polishing tool, for uniformly pressurizing the workpiece toward the annular polishing tool; and a polishing-position retaining mechanism for holding the workpiece and the disciform pressurizing member at a predetermined polishing position by preventing them from moving in unison with the annular polishing tool, while permitting them to rotate, as the annular polishing tool rotates. An outer diameter of the annular polishing tool is set to a value which is larger than a diameter of a circumcircle of the workpiece placed on the polishing tool face and smaller than twice the diameter of the circumcircle of the workpiece.

In the present invention, when the surface polishing machine is brought into operation, the annular polishing tool rotates in the direction A shown in FIG. 1, as in the aforementioned prior art example. At this time, the workpiece, placed on the polishing tool face, and the disciform pressurizing member attempt to rotate in the same direction as the rotating direction of the polishing tool. However, such a rotary motion is prevented by the polishing-position retaining mechanism, so that the workpiece and the pressurizing member are retained at the predetermined position shown in FIG. 1. Thus, appropriate friction is developed between the workpiece and the polishing tool face. Further, the workpiece rotates around its axis due to the difference between peripheral velocities of the polishing tool on its inner and outer diameter sides. Therefore, even if the workpiece has its diameter larger than the radial width of the annular polishing tool face, a portion of the workpiece which extends off the polishing tool face will be brought in contact with and rubbed against the polishing tool face, whereby smooth polishing is accomplished over the entirety of the workpiece.

That is, according to the present invention, the workpiece is subject to effective polishing even if the diameter of the workpiece is larger than the radial width of the polishing tool face. In this regard, the polishing machine of this invention is advantageous in that it can be compact in overall size.

In the present invention, preferably, the polishing-position retaining mechanism has a polishing-position variably setting function for variably setting the center of rotation of the workpiece and the disciform pressurizing member at an arbitrary position on the polishing tool face of the annular polishing tool and for retaining them at that position.

With this preferable arrangement, the workpiece and the pressurizing member can be placed at an arbitrary position on the polishing tool face, and hence an optimum polishing position for each individual workpiece can be attained in accordance with the size of the workpiece or the like. Since the workpiece can be swung, if necessary, on the polishing tool face by variably setting the polishing position during the polishing, the polishing machine is advantageous in that it has greater versatility in polishing workpieces of various sizes.

Preferably, the polishing-position retaining mechanism has a workpiece-centroid-position setting function for making the centroid position of the workpiece coincident with the center position of an area in which the annular polishing tool is in contact with the workpiece.

According to this preferred arrangement, the contact area between the machined face of the workpiece and the polishing tool face is large, to make it possible to continuously carry out the polishing accurately efficiently in a stable manner. Namely, this arrangement is advantageous in that the polishing efficiency is improved.

To attain the polishing-position variably setting function or the workpiece-centroid-position setting function, preferably, the polishing-position retaining mechanism includes an arm member disposed above the polishing tool face of the annular polishing tool, support rollers mounted to the arm member so as to be movable in unison therewith and adapted to abut against an outer peripheral face of the workpiece, a drive mechanism section for moving the arm member, and a control section for drivingly controlling the drive mechanism section.

In the present invention and the aforementioned two preferred arrangements, preferably, the surface polishing machine further comprises a disciform dresser disposed on the polishing tool face of the annular polishing tool at a location upstream of the workpiece as viewed in the rotational direction of the annular polishing tool. The disciform dresser has its diameter larger than a radial width of the annular polishing tool face and serves to dress the polishing tool face.

This preferable arrangement makes it possible to prevent the polishing tool face of the polishing tool from being clogged, thereby always offering a fresh polishing tool face, and therefore, the polishing operation for the workpiece can be efficiently continued.

Preferably, the polishing machine further comprises an abrasive-fluid supplying mechanism disposed above the polishing tool face of the annular polishing tool at a predetermined distance therefrom and disposed on the side upstream of the workpiece in the rotational direction of the annular polishing tool, the abrasive-fluid supplying mechanism having a plurality of fluid jet nozzles for supplying abrasive fluid to the polishing tool face of the annular polishing tool; and an abrasive-fluid sucking mechanism, disposed on the polishing tool face of the annular polishing tool at a location downstream of the workpiece in the rotational direction of the annular polishing tool, for sucking and collecting used abrasive fluid from the polishing tool face.

With this preferred arrangement, the used abrasive fluid is prevented from staying on the polishing tool face, and therefore, intended machining conditions for the polishing can be always maintained. This arrangement is advantageous in that accurate polishing can be continued for a long time.

In this invention, preferably, the polishing machine further comprises an abrasive-fluid supplying mechanism, disposed above the polishing tool face of the annular polishing tool at a location upstream of the workpiece in the rotational direction of the annular polishing tool, for supplying abrasive fluid to the polishing tool face of the annular polishing tool; and an abrasive-fluid sucking mechanism, disposed on the polishing tool face of the annular polishing tool at a location downstream of the disciform dresser in the rotational direction of the annular polishing tool, for sucking and collecting used abrasive fluid from the polishing tool face.

With this arrangement, the abrasive fluid serves to restore the sharpness of the disciform dresser, and therefore a deterioration in the polishing ability of the polishing tool face of the annular polishing tool with elapse of time can be effectively suppressed while the polishing tool is being continuously used for the polishing.

More preferably, the abrasive-fluid sucking mechanism extends in the width direction of the polishing tool face of the annular polishing tool, the abrasive-fluid sucking mechanism having an abrasive-fluid sucking face thereof facing the polishing tool face of the annular polishing tool and formed with a plurality of abrasive-fluid sucking holes many of which are formed in inner- and outer-diameter-side regions of the abrasive-fluid sucking face of the abrasive-fluid sucking mechanism.

With this arrangement, the used abrasive fluid can be efficiently collected, and therefore the polishing ability of the polishing tool face can be satisfactorily maintained.

More preferably, the abrasive-fluid sucking face of the abrasive-fluid sucking mechanism has both end portions thereof provided with a plurality of shallow grooves communicating with outside air.

This preferred arrangement is advantageous in that the used abrasive fluid on the polishing tool face can be more efficiently collected.

Preferably, the surface polishing machine further comprises an abrasive-fluid collecting bath formed into a U-shape in cross section and adapted to rotate in unison with the annular polishing tool, the abrasive-fluid collecting bath having a raised portion thereof facing an outer peripheral portion of the annular polishing tool with a predetermined distance; and an abrasive-fluid recovering mechanism, attached to the abrasive-fluid collecting bath, for sucking the abrasive fluid collected in the abrasive-fluid collecting bath and for delivering the collected abrasive fluid to the outside.

With this preferred arrangement, the abrasive fluid liable to be dispersed from the polishing tool face can be effectively recovered and hence the surroundings of the polishing machine can be prevented from being contaminated with the abrasive fluid.

Preferably, the surface polishing machine further comprises a regenerative circulating unit for recycling the abrasive fluid sucked and recovered by the abrasive-fluid sucking mechanism and for delivering the same to the abrasive-fluid supplying mechanism.

With this arrangement, the abrasive fluid can be recycled for reuse and hence an amount of consumption of the abrasive fluid can be reduced. Advantageously, this arrangement attains an improved productivity in polishing operation.

According to another aspect of the present invention, a surface polishing machine is provided, which comprises a polishing tool having a polishing tool face and adapted to be rotatively driven; a pressurizing member for pressurizing a workpiece, placed on the polishing tool face of the polishing tool, toward the polishing tool face; a polishing-position retaining mechanism for holding the workpiece at a predetermined polishing position, while permitting the workpiece to rotate, as the polishing tool rotates; and an abrasive-fluid supplying mechanism for supplying abrasive fluid to the polishing tool face of the annular polishing tool. The polishing tool face is formed with an annular groove coaxially with the center of rotation of the polishing tool, and the annular groove extends to pass through the center of rotation of the workpiece placed on the polishing tool face of the polishing tool.

According to the just-mentioned surface polishing machine of this invention, the abrasive fluid can be supplied, without causing excessive or insufficient supply of abrasive fluid, to a central part of the workpiece through the annular groove that is formed in the polishing tool face so as to pass through the center of rotation of the workpiece. Further, elastic deformation of the polishing tool caused by the pressurized contact between the workpiece and the polishing tool is relieved by the annular groove, to make it possible to reduce the wear and gouge of the polishing tool at its central portion. As a result, the inner peripheral portion of the machined face of the workpiece can be machined properly as in the outer peripheral portion thereof, whereby an adequately flat surface can be machined on a large diameter workpiece.

Preferably, the annular groove formed in the polishing tool face of the polishing tool is comprised of a single recessed groove or a group of recessed grooves spaced from one another with a small pitch in the radial direction of the polishing tool.

With this preferred arrangement, the abrasive fluid can be supplied to the entire machined face, including a central part, of the workpiece through the annular groove comprised of the single recessed groove or the group of recessed grooves.

Preferably, the polishing tool face of the polishing tool is formed with at least one radial groove extending radially toward the outer periphery of the polishing tool and communicating with the annular groove formed in the polishing tool face.

With this arrangement, chippings produced by the polishing can be discharged from the polishing tool face through the annular groove and the radial groove formed in the polishing tool face, with the aid of the abrasive fluid flowing therethrough.

Preferably, the surface polishing machine further comprises a swinging mechanism for causing the workpiece to swing on the polishing tool face of the polishing tool over a swing width wider than the entire width of the annular groove.

With this preferable arrangement, a central part of the machined face of the workpiece can be polished, with satisfactory evenness or flatness similar to that attainable at an outer peripheral part of the machined face, by swinging or angularly moving the workpiece on the polishing tool face, Preferably, the polishing tool face of the polishing tool is divided into an inner peripheral portion, an outer peripheral portion, and an annular groove portion by the annular groove. The abrasive-fluid supplying mechanism is provided with a plurality of nozzles for supplying the abrasive fluid to the inner peripheral portion, the outer peripheral portion, and the annular groove portion of the polishing tool face, respectively.

With this arrangement, the abrasive fluid can be appropriately supplied to respective portions of the polishing tool face, whereby the abrasive fluid can be uniformly supplied to the entire machined face of the workpiece, to ensure that the workpiece is polished with adequate evenness.

Preferably, the polishing tool contain, as its ingredient, a cashew resin.

With this arrangement, large friction is developed between the workpiece and the polishing tool made of cashew resin, so that an increased polishing rate may be attained.

Preferably, the surface polishing machine further comprises a dresser disposed on the polishing tool face of the polishing tool at a location upstream of the workpiece in the direction of rotation of the polishing tool. The dresser has a dressing region whose length is longer than the radius of the polishing tool face to cover the entire radial width of the polishing tool face. The dresser is comprised of a tapered-roller type dresser whose diameter increases toward the outer periphery of the polishing tool or a disciform dresser adapted to be reciprocated in the radial direction of the polishing tool.

With this arrangement, the entirety of the polishing tool face can be dressed by the dresser whose dressing region having a length longer than the radius of the polishing tool face.

Preferably, the surface polishing machine further comprises an abrasive-fluid sucking mechanism disposed at a location upstream of the dresser in the direction of rotation of the polishing tool. The location of the abrasive-fluid supplying mechanism is symmetric with the location of the dresser with respect to a diametrical line of the polishing tool. The abrasive-fluid sucking mechanism has a sucking region whose length is longer than the radius of the polishing tool face of the polishing tool to cover the entire radial width of the polishing tool face.

With this arrangement, the polishing can be implemented in a stable manner by sucking and removing the used abrasive fluid and chippings.

DETAILED DESCRIPTION OF THE PREFERRED EMBODIMENT

With reference to FIGS. 1–4, a surface polishing machine according to a first embodiment of this invention will be explained.

Figure 1:
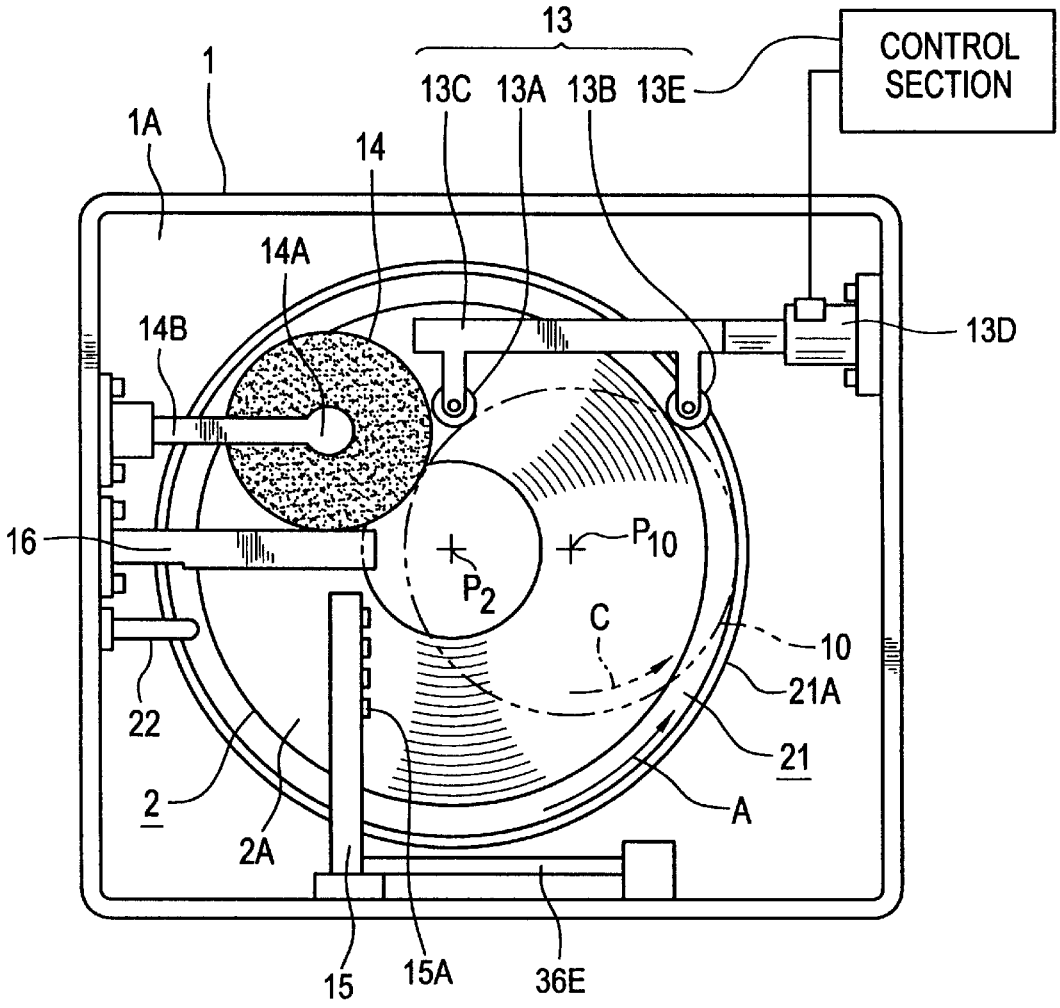
FIG. 1 is a schematic plan view of a surface polishing machine according to a first embodiment of the present invention.
Figure 2:
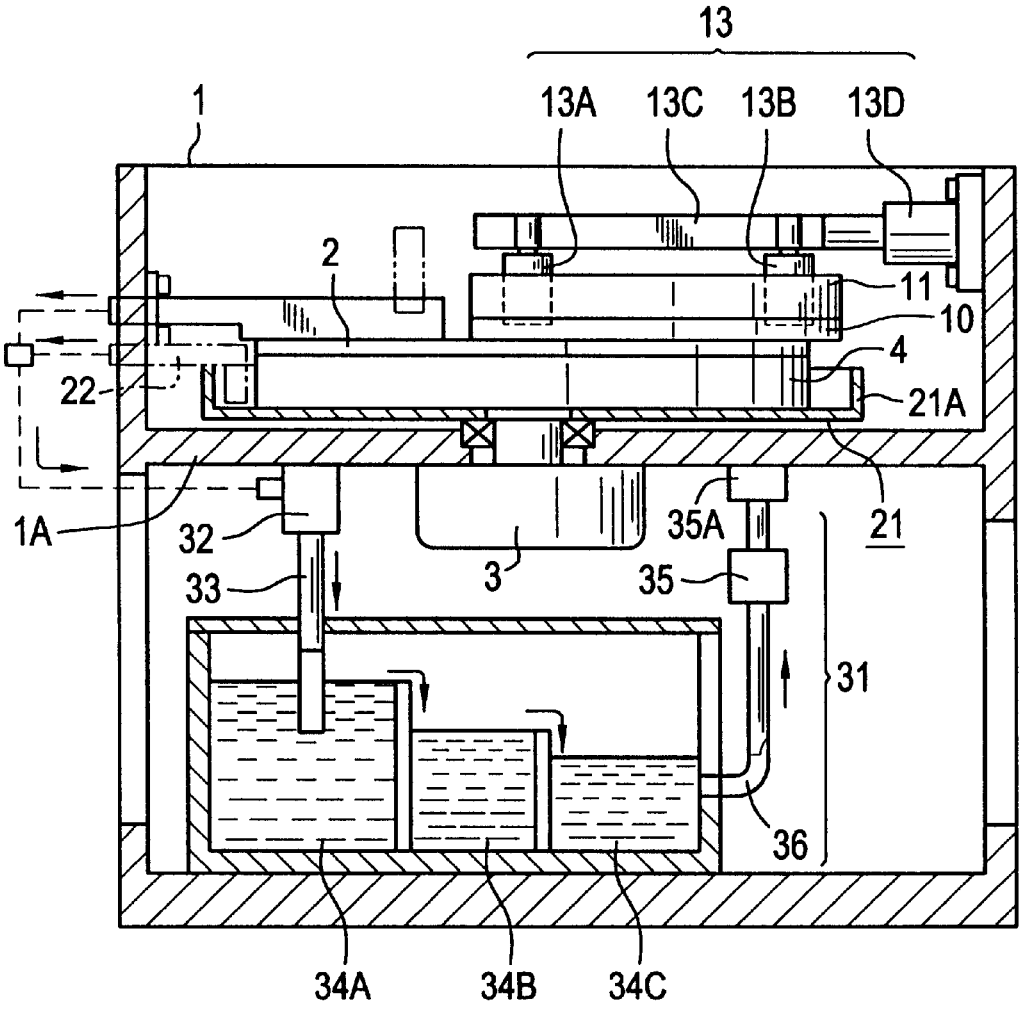
FIG. 2 is a schematic vertical section view showing, partly omitted, the polishing machine shown in FIG. 1.

In FIGS. 1 and 2, reference numeral 1 denotes a housing of the polishing machine, and 1A denotes an upper floor of the housing 1. A turntable 4 disposed at a central part of the upper floor 1A is adapted to be rotatably driven by a drive motor 3. An annular polishing tool 2, disposed on the turntable 4, has a polishing tool face 2A thereof formed into an annular shape and arranged in a horizontal position to constitute a horizontal machining face.

The polishing tool face 2A of the polishing tool 2 is so arranged that a disciform workpiece 10 is placed thereon, the workpiece having a machined surface thereof subject to polishing. During the polishing, the workpiece 10 is uniformly pressed toward the polishing tool 2 by means of a disciform pressurizing member 11 placed on the workpiece, so that the machined surface of the workpiece 10 may be polished uniformly accurately.

In the present embodiment, the disciform pressurizing member 11 has the same diameter as the diameter D10 of the workpiece 10, as shown in FIGS. 1 and 2, and serves to press, under its own weight, the workpiece 10 toward the polishing tool 2. The pressurizing member 11 can be easily mounted on the workpiece 10 integrally therewith and can be easily dismounted therefrom, to thereby improve accessibility.

As for the disciform pressurizing member 11, it may have a diameter different from the diameter D10 of the workpiece 10 so long as it can uniformly press the workpiece toward the annular polishing tool. Although the pressurizing member 11 shown in FIGS. 1 and 2 is designed to utilize its own weight in pressurizing the workpiece 10 toward the polishing tool 2, another pressurizing member can be employed which achieves the same pressurizing function in another fashion (e.g., by forcible pressurization). Instead of the disciform pressurizing member 11, a pressurizing member having a shape other than a disk shape may be used.

A polishing-position retaining mechanism 13 is disposed above the polishing tool 2 at a location downstream of the workpiece 10 in the rotational direction A of the polishing tool 2. After the polishing tool 2 is brought into operation to start its rotary motion, the retaining mechanism 13 achieves a polishing-position retaining function for permitting the workpiece 10 and the pressurizing member 11 to rotate, while preventing them to move in unison with the polishing tool 2, to thereby hold the workpiece and the pressurizing member at a predetermined polishing position.

More specifically, the polishing-position retaining mechanism 13 is comprised of at least two support rollers 13A and 13B that are mounted on an arm member 13C disposed above the polishing tool face of the polishing tool 2. The arm member 13C is formed with two projections that are separated from each other at a predetermined distance in the lengthwise direction of the arm member. The support rollers are rotatably supported by the projections of the arm member so as to be abut against the outer peripheral face of the workpiece 10 placed on the polishing tool. The arm member 13C has a proximal end portion thereof held by the housing 1 through an expandable driving mechanism section 13D.

The driving mechanism section 13D has a function of reciprocating, i.e., expanding and contracting the arm member 13C, where required, in the direction along which the arm member extends. Reference numeral 13E denotes an operation control section for controlling the operation of the expandable driving mechanism section 13D.

With this arrangement, the reciprocal moving position (effective length) of the arm member 13C can be changed and hence the positions of the two support rollers 13A and 13B relative to the polishing tool 2 can be changed, to thereby select an optimum polishing position of the workpiece 10 on the polishing tool face 2A of the polishing tool 2.

In other words, based on expanding and contracting actions of the expandable driving mechanism section 13D, the polishing-position retaining mechanism 13 is capable of variably setting the center P10 of rotation of the workpiece 10 and the pressurizing member 11 at an arbitrary position on the polishing tool face 2A of the polishing tool 2 and of retaining them at that position, to thereby achieve the polishing-position variably setting function.

With this arrangement, unbalanced wear-out of the polishing tool face 2A, caused when the same part of the tool face is repeatedly utilized in the polishing of a considerable number of workpieces, can be positively prevented.

The polishing-position retaining mechanism is designed to control the actions of the driving mechanism section 13D by means of the control section 13E, to achieve a workpiece-centroid-position setting function of making the centroid position P10 of the workpiece 10 coincident with the center position (centroid) Ps of an area in which the annular polishing tool 2 is in contact with the workpiece 10.

Experimental data indicates that accurate and efficient polishing can be continued in a stable manner, if the polishing is carried out in a condition that the center position of the contact area between the annular polishing tool 2 and the workpiece 10 is coincident with the centroid position P10 of the workpiece.

A disciform dresser 14 is disposed in contact with the polishing tool face 2A of the annular polishing tool 2 on the side downstream of the workpiece as viewed in the rotational direction A of the annular polishing tool 2. The disciform dresser 14 has its diameter slightly larger than the radial width W of the annular polishing tool face 2A. The dresser 14 is mounted, together with a compact drive motor 14A to an arm-shaped holding member 14B extending from the housing 1, and is adapted to be rotatably driven by the drive motor 14A.

By means of the disciform dresser 14, the polishing tool face 2A of the polishing tool 2 is always prevented from being clogged, whereby a fresh polishing tool face can be always offered. For this reason, the polishing operation can be smoothly carried out without lowering the polishing efficiency with elapse of time.

Further, an abrasive-fluid supplying mechanism 15 is disposed above the polishing tool face 2A of the annular polishing tool 2 with a predetermined distance therefrom. The fluid supplying mechanism 15 is provided with a plurality of fluid jet nozzles 15A for supplying abrasive fluid over substantially the entire radial width W of the polishing tool face 2A. Also, there is provided an abrasive-fluid sucking mechanism 16 for sucking and collecting the abrasive fluid, having been used for the polishing, from substantially the entire radical width W of the polishing tool face 2A as the polishing tool rotates.

The abrasive-fluid supplying mechanism 15 is disposed to be close to the workpiece 10 on the side upstream of the workpiece 10 in the rotational direction A of the annular polishing tool 2. On the other hand, the abrasive-fluid sucking mechanism 16 is disposed to be close to the disciform dresser 14 at a location downstream of the dresser 14 in the rotational direction A of the annular polishing tool 2.

With this arrangement, the abrasive fluid, jetted to a portion of the polishing tool face 2A on the side upstream of the workpiece 10, passes the workpiece 10 and the disciform dresser 14, and is then sucked by the abrasive-fluid sucking mechanism 16.

Meanwhile, in another arrangement where no disciform dresser 14 is provided, the abrasive-fluid sucking mechanism 16 may be disposed downstream of the workpiece 10 in the rotational direction A of the polishing tool 2.

Figure 4:
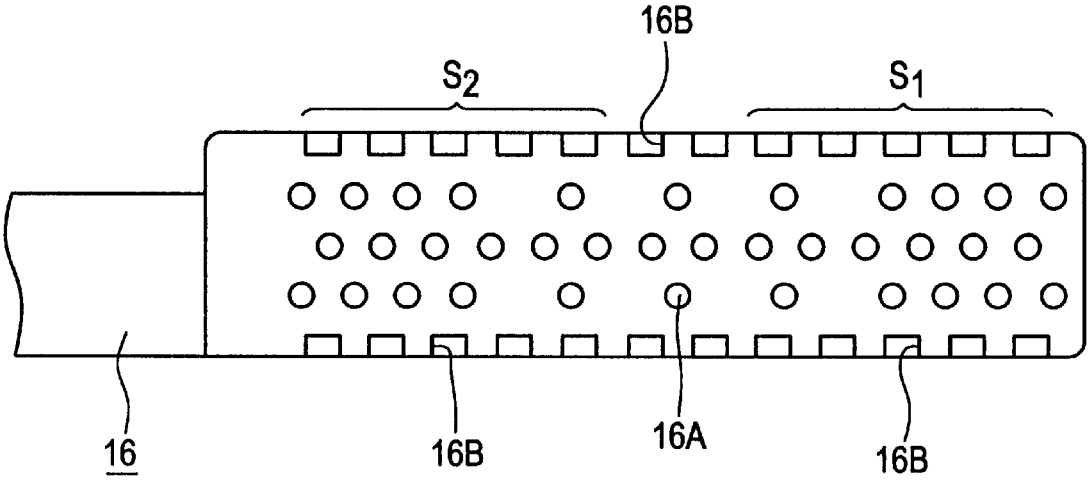
FIG. 4 is a view showing by way of example an abrasive-fluid sucking face of an abrasive-fluid sucking mechanism shown in FIG. 1.

In the present embodiment, the abrasive-fluid sucking mechanism 16 extends in the radial width direction of the polishing tool face 2A of the annual polishing tool 2. As shown in FIG. 4, the abrasive-fluid sucking mechanism 16 is provided with an abrasive-fluid sucking face, facing the polishing tool face 2A of the polishing tool 2, with a plurality of abrasive-fluid sucking holes 16A. Those holes 16A formed in each of inner- and outer-diameter-side regions S1 and S2 of the abrasive-fluid sucking face of the fluid sucking mechanism 16 are greater in number than the holes formed in a central region thereof. As a result, the used abrasive fluid, which is liable to stay at inner- and outer-diameter-side regions of the polishing tool face 2A during the polishing, can be efficiently sucked therefrom.

Moreover, as shown in FIG. 4, a plurality of shallow grooves 16B, communicating with the atmospheric air, are provided at both end portions of the abrasive-fluid sucking face, facing the polishing tool face 2A, of the abrasive-fluid sucking mechanism 16, so that the used abrasive fluid may be easily sucked by the fluid sucking mechanism 16.

Next, the annular polishing tool 2 will be explained in detail.

Figure 3:
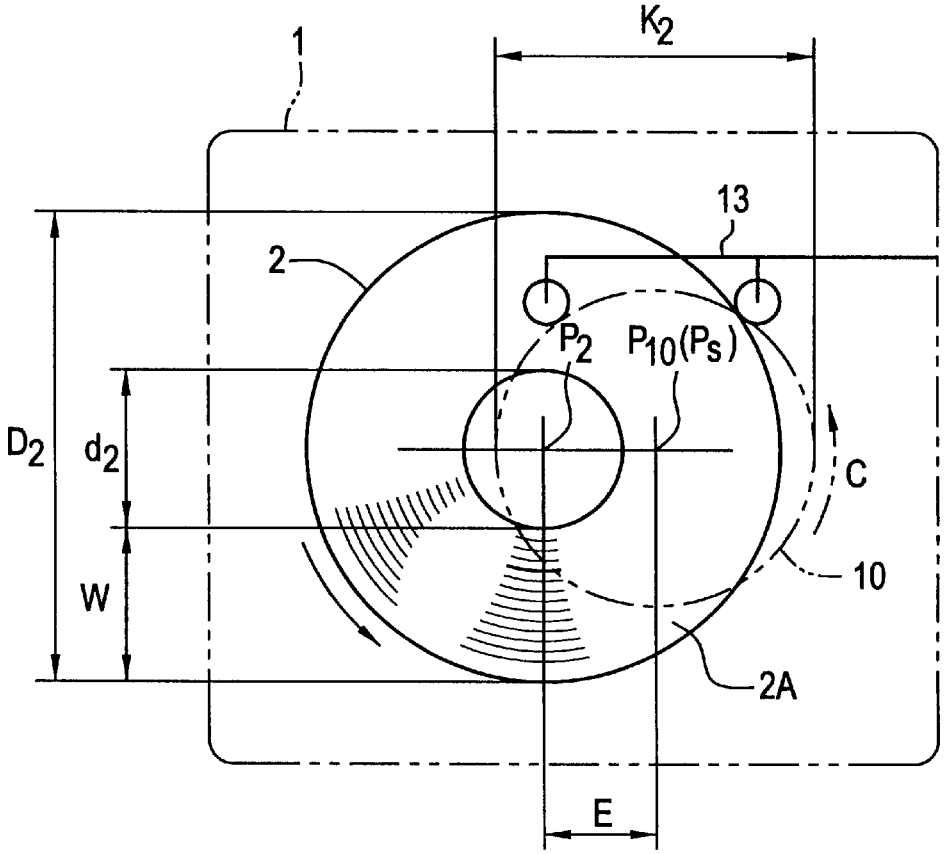
FIG. 3 is a view showing the relationship between the size of an annular polishing tool and that of a workpiece shown in FIG. 1 and showing the positional relationship therebetween at the time of polishing.

In this embodiment, as shown in FIG. 3, the outer diameter D2 of the annular polishing tool 2 is set to a value larger than the diameter K2 of the disciform workpiece 10 (in general, the diameter of the circumcircle of the workpiece) and smaller than twice the workpiece diameter K2. For a workpiece having a noncircular shape, the diameter (circumcircle diameter) of the workpiece is represented by the diameter of a circular trajectory described by the outermost part of the workpiece when it rotates on the polishing tool face around the center point of the contact area between itself and the polishing tool face.

In the case of the annular polishing tool 2 used for a 12 in. wafer (300 mm in outer diameter) serving as the disciform workpiece 10, the polishing tool has a 480 mm outer diameter D2 and a 120 mm inner diameter d2, for instance (refer to FIG. 3). In this case, the center P10 of rotation of the workpiece 10 (i.e., the centroid (average center position) PS of the contact area between the workpiece 10 and the annular polishing tool 2) is 130 mm (=E) apart from the center P2 of the polishing tool.

Figure 6:
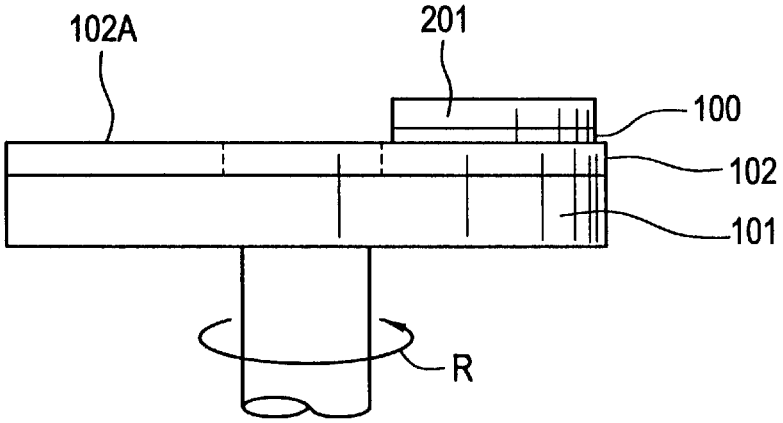
FIG. 6 PRIOR ART
FIG. 6 is a schematic side view exemplarily showing a conventional surface polishing machine.
Figure 7:
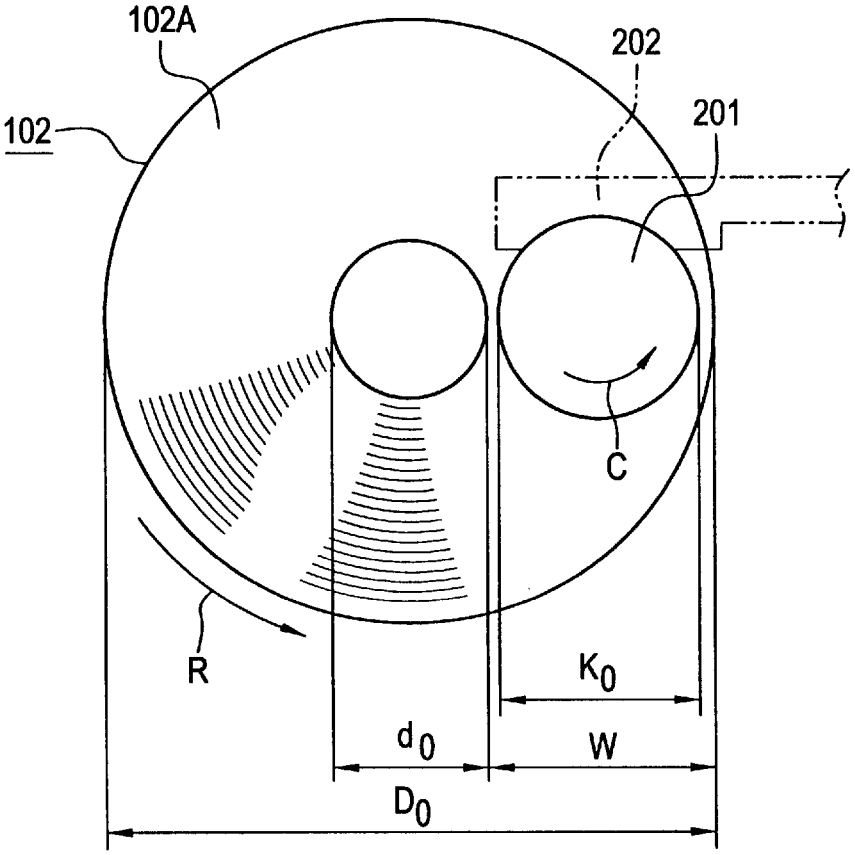
FIG. 7 PRIOR ART
FIG. 7 is a schematic plan view of the polishing machine shown in FIG. 6.

On the other hand, a conventional annular polishing tool 102 exemplarily shown in FIGS. 6 and 7 requires an annular polishing tool face 102A whose radial width W is wider than 300 mm and whose inner diameter d0 is greater than 120 mm, when it is used for a wafer which is 300 mm in diameter K0. This indicates that the conventional polishing tool 102 becomes larger in outer diameter D0 than 720 mm.

As explained above, the annular polishing tool of this embodiment can be compact in size to the extent that its outer diameter is about half of that of the conventional polishing tool. Since the area ratio varies inversely with the square of the diameter ratio, the area of the polishing tool of the embodiment is about half of that of the conventional tool under the same conditions of workpiece diameter.

With use of the annular polishing tool 2, part of the workpiece 10, corresponding to the inner diameter portion d2 of the annular polishing tool 2, cannot be polished satisfactorily in a condition that the workpiece is kept unrotatable, even if the outer diameter D2 of the polishing tool 2 is greater than the diameter K2 of the workpiece 10, as shown in FIG. 3.

However, since the workpiece 10 rotates around its axis on the polishing tool face 2A of the polishing tool 2 with rotation of the polishing tool, while being retained at a predetermined location on the polishing tool face 2A, it is ensured that the polishing is made over the entire machined surface of the workpiece 10.

For this reason, the radial width W of the annular polishing tool face 2A may be set to a value smaller than the diameter K2 of the workpiece 10 so long as the outer diameter D2 of the annular polishing tool 2 is greater than the workpiece diameter K2. In the case of a noncircular workpiece, as mentioned above, the workpiece diameter K2 is represented by the diameter of the circumcircle of the workpiece, i.e., the diameter of a circular trajectory developed by the workpiece when it rotates on the polishing tool.

A detailed explanation as to the disciform dresser 14 will be given below.

The disciform dresser 14 shown in FIGS. 1 and 2 has its diameter of, e.g., 200 mm, which is larger than the radical width W, e.g., 180 mm, of the polishing tool face 2A. Thus, the dressing is made over the entirety of the polishing tool face 2A, whereby the workpiece 10 can be always polished by means of the thus dressed polishing tool face 2A.

With the intention of providing the dresser 14 having an efficient dressing ability, while lowering the overall cost thereof, a small amount of natural diamond particles (150 micrometers in particle size), having high wear resistance and capable of sharply dressing the polishing tool face 2A although they are high-priced, is embedded in a tool-face side of the disciform dresser 14 together with a large amount of artificial diamond particles (100 micrometers) which are low-priced and contribute to the dressing to some extent although they are liable to be wear out. The resultant dresser 14 is excellent in cost/performance ratio and dressing efficiency. Moreover, a clean polishing tool face 2A is offered since the tool face is subject to the dressing, without fail, as the annular polishing tool 11 rotates.

In order to avoid damage to the dresser 14, an outer peripheral portion of the abrasive-fluid sucking face of the abrasive-fluid sucking mechanism 16 is rounded off (with radius of 2 mm).

The abrasive-fluid sucking face is formed with abrasive-fluid sucking holes (having their diameters of about 1 mm) 16A in such a manner that the fluid sucking holes formed at each of inner and outer-diameter regions S1 and S2 of the abrasive-fluid sucking face, which face the inner and outer radical portions of the polishing tool face 2A where the abrasive fluid is liable to stay, are about three times greater in number than those formed at a central portion thereof.

As a result, clean abrasive fluid is always supplied to the workpiece 10 placed on the polishing tool face 2A, whereby the surface polishing can be always done in a clean condition without being affected by foreign matters which would otherwise accumulate on the tool face.

Reference numeral 21 denotes an abrasive-fluid collecting bath having a U-shaped cross section and surrounding the outer periphery of the annular polishing tool 2.

The abrasive-fluid collecting bath 21 is provided with an annular raised portion 21A on its outer periphery. The fluid collecting bath 21 has a function of recovering the abrasive fluid which, when receiving a centrifugal force, is liable to draw out to the outside of the polishing machine. The fluid collecting bath 21 is formed coaxially with and integrally with the annular polishing tool 2, and is adapted to rotate in unison therewith.

An abrasive-fluid recovering mechanism 22, is disposed in the fluid collecting bath 21, and mounted on the housing 1. The fluid recovering mechanism 22 serves to suck the abrasive fluid collected in the fluid collecting bath 21 and deliver the collected abrasive fluid to the outside. A distal end portion of the recovering mechanism 22, serving as a fluid sucking section, extends into an inner bottom section of the fluid collecting bath 21.

With this arrangement, during the polishing process of the workpiece 10, the abrasive fluid is smoothly recovered by the functions of the fluid collecting bath 21 and the fluid recovering mechanism 22, without being dispersed to the outside. As a result, most of the used abrasive fluid and chippings are recovered efficiently.

The abrasive fluid, sucked and recovered by the fluid sucking and recovering mechanisms 16 and 22, is recycled by a regenerative circulating unit 31 and supplied therefrom to the abrasive-fluid supplying mechanism 15.

As shown in FIG. 2, the regenerative circulating unit 31 is comprised of a fluid recovering piping 33 provided with a sucking-side pump 32, abrasive-fluid regenerating baths 34A, 34B, and 34C having three-stage sedimentiation baths in which the abrasive fluid recovered by the fluid recovering piping 33 is subject to filtration, while overflowing from the upstream-most side sedimentiation bath 34A to the intermediate bath 34B and from the bath 34B to the downstream-most side bath 34C. The unit 31 further comprises a fluid resupplying piping 36 provided with a supplying-side pump 35 for sucking supernatant fluid from the bath 34C and for delivering the same to the abrasive-fluid supplying mechanism 15.

The regenerative circulating unit 31 is accommodated in a lower part (below the upper floor section 1A) of the housing 1, except for the fluid recovering piping 33 and the fluid resupplying piping 36.

With this construction, the abrasive fluid and foreign matters such as chippings are recovered from the polishing tool face 2A by the abrasive fluid sucking and recovering mechanisms 16, 22 and delivered into the fluid regenerating baths 34A, 34B and 34C, whereby the abrasive fluid is recycled for reuse.

The supplying-side pump 35 has a delivering capacity of about 100 cc per minute, for instance, and is provided at its output side with a filter 35A having a 50 micrometer mesh and a 5 micrometer mesh, to thereby achieve a function of removing foreign mattes that are unremoved in the fluid regenerating baths 34A, 34B and 34C.

The abrasive fluid recycled in the baths 34A, 34B and 34C is drawn into the supplying-side pump 35 where fine particles are removed, and is then delivered to the fluid supplying mechanism 15 through the fluid resupplying piping 36 (FIG. 2) and the resupplying piping 36E (FIG. 1).

Next, operations of the polishing machine of the present embodiment will be explained.

After the workpiece 10 and the pressurizing member 11 are placed on the polishing tool face 2A of the polishing tool 2, as shown in FIGS. 1 and 2, the polishing machine is brought into operation. As a result, the polishing tool 2 rotates in the direction A shown in FIG. 1. Although the workpiece 10 and the pressurizing member 11 placed on the polishing tool face 2A attempt to rotate in the same direction in unison with the polishing tool, such a rotary motion is prohibited by the polishing-position retaining mechanism 13 and hence they are retained at the predetermined position illustrated in FIG. 1.

As a consequence, predetermined friction is developed between the machined face of the workpiece 10 and the polishing tool face 2A of the polishing tool. Due to the difference between the peripheral velocity of the polishing tool face 2A on the inner-diameter side and that on the outer-diameter side, frictional forces developed on the inner- and outer-diameter sides of the tool face are different in magnitude from each other. Attributable to this frictional force difference, the workpiece 10 rotates around its axis on the polishing tool face 2A in the direction C shown in FIG. 1. Symbol P10 denotes the center of rotation of the workpiece 10.

In case of the workpiece having the diameter D2 larger than the radial width W of the annular polishing tool face 2A, a portion of the workpiece extends off the polishing tool face. As the workpiece 10 rotates, however, the entire machined face of the workpiece, including the extending-off portion, is brought in contact with and rubbed against the polishing tool face 2A, whereby smooth polishing is accomplished over the entire machined face of the workpiece 10. That is, with this embodiment, the workpiece 10 is effectively subject to the polishing even if the diameter D2 of the workpiece is larger than the radial width W of the polishing tool face 2A. Thus, the polishing machine can be advantageously compact in overall size.

As explained above, the polishing position of the workpiece 10 is restricted by the polishing-position retaining mechanism 13, and at the same time, is moved (swung or reciprocated at fixed intervals) under the control of the control section 13E.

Upon start of the operation of the polishing machine, the dresser 14 and the compact motor 14A for driving the dresser are brought into operation, and at the same time operations of the fluid sucking mechanism 16, fluid recovering mechanism 22, and regenerative circulating unit 31 are started.

As a result, the polishing tool face 2A is always dressed by the dresser 14, and at the same time fresh abrasive fluid is always supplied to the polishing tool face 2A by the functions of the fluid sucking mechanism 15, fluid recovering mechanism 22, and regenerative circulating unit 31.

For these reasons, an accurate polishing process is smoothly continued, without causing an undesired clogging of the polishing tool face 2A with elapse of time.

The following are results of an experiment in respect of the polishing machine of the embodiment.

In the experiment, a 300 mm outer diameter wafer (12 in. wafer) formed with a silicon dioxide film was subject to polishing where an annular polishing tool 11 made of polyurethane and having a 480 mm outer diameter and a 120 mm inner diameter was used, together with abrasive fluid containing colloidal silica of a 100 angstrom particle size. The experiment was carried out for five minutes under the condition that the polishing tool was rotated at a rotational speed of 24 rpm, and the wafer was applied with a pressurizing pressure of 600 grams per square centimeter and swung by the polishing-position retaining mechanism 13 with a 40 mm swinging width.

The evenness of ±3% was attained when the polishing was made on the 12 in. wafer with a polishing amount of 15000±500 angstroms. This result indicates that the polishing machine is capable of implementing highly accurate polishing on such a large diameter wafer, despite that it is compact in size (the area of the polishing tool is about than half the conventional one).

Next, a surface polishing machine according to a second embodiment of this invention will be explained with reference to FIG. 5.

The second embodiment is featured in that it comprises a disciform dresser and a driving mechanism therefor which are different in construction from the dresser 14 and the driving mechanism shown in FIGS. 1–4.

Figure 5:
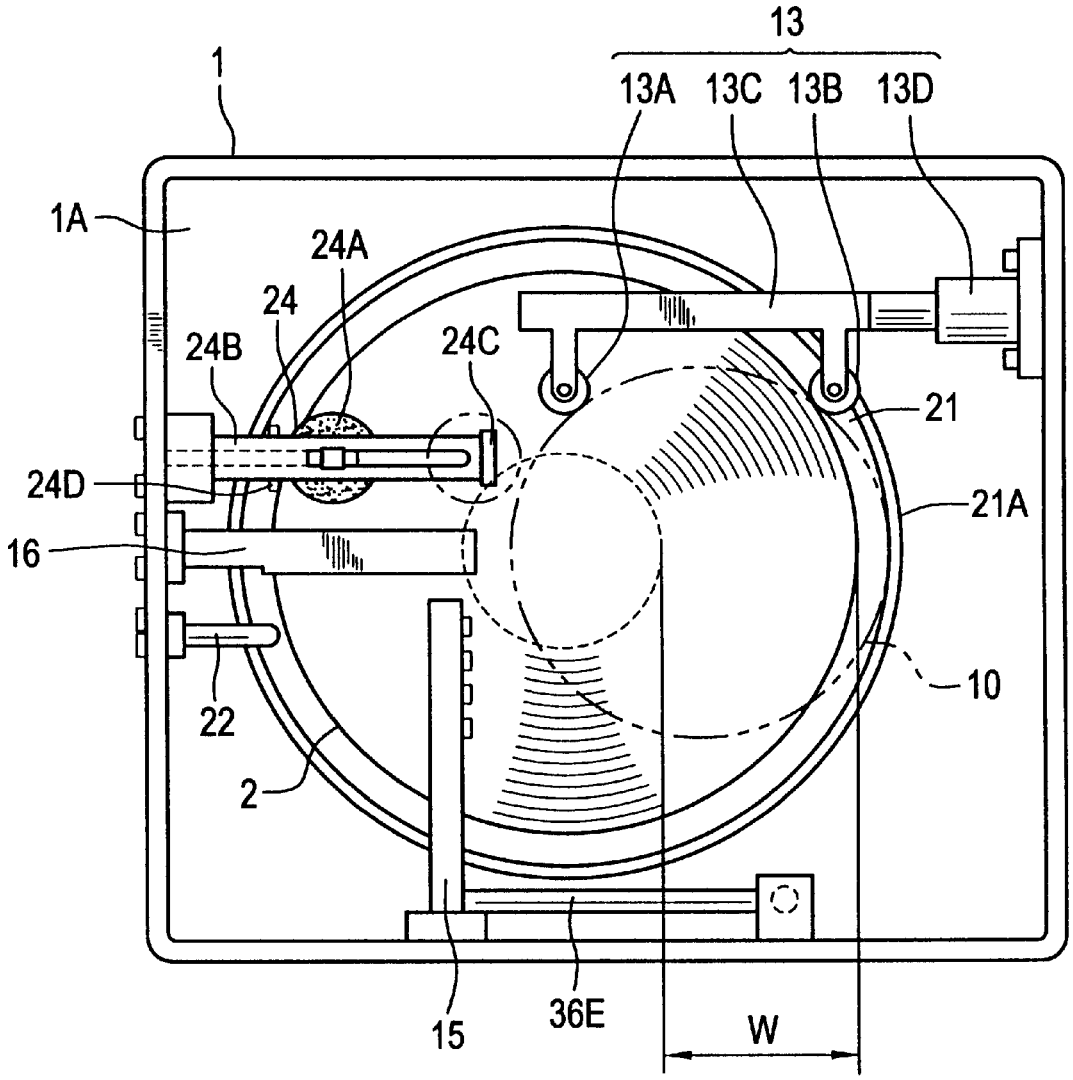
FIG. 5 is a schematic plan view of a surface polishing machine according to a second embodiment of this invention.

Referring to FIG. 5, the disciform dresser 24 is small in diameter (e.g., 75 mm in outer diameter). Specifically, the diameter of the dresser 24 is smaller than the radial width W of the annular polishing tool face 2A of the polishing tool. The dresser 24, formed into one piece with a small drive motor 24A, is mounted to an arm member 24B extending in the radial direction of the polishing tool. The dresser 24 is adapted to make a reciprocal motion on the arm member 24B within a predetermined range when it is actuated by a reciprocal motion mechanism, including the motor 24A. For instance, the reciprocal motion mechanism includes a rack-and-pinion section comprised of a pinion formed on the output shaft of the motor 24A and a rack (toothed slot) meshing therewith and formed in the arm member 24B.

During the reciprocal motion, the dresser 24 driven by the motor 24A makes reversal actions under the control of controlling means (not shown) responsive to reversal signals that are delivered from micro-switches 24C and 24D mounted at both end portions of the arm member 24B.

In other respects, the polishing machine of FIG. 5 is the same in construction as the machine shown in FIGS. 1–4. The polishing machine of FIG. 5 achieves the same functions and advantages as those achieved by the polishing machine of FIGS. 1–4.

The following are results of an experiment in respect of the polishing machine of the second embodiment shown in FIG. 5. The experiment was carried out in the same conditions as those for the first embodiment. The evenness of ±4% was obtained when the polishing of a 12 in. wafer was made with a polishing amount of 15000±600 angstroms. This indicates that highly accurate polishing on such a large diameter wafer can be carried out with use of the polishing machine of this embodiment, which is compact in size.

In the following, a surface polishing machine according to a third embodiment of this invention will be explained with reference to FIGS. 8 and 9.

The polishing machine of this embodiment is featured in that it comprises a polishing tool formed into a disk-shape and having a polishing tool face formed with an annular groove.

Figure 8:
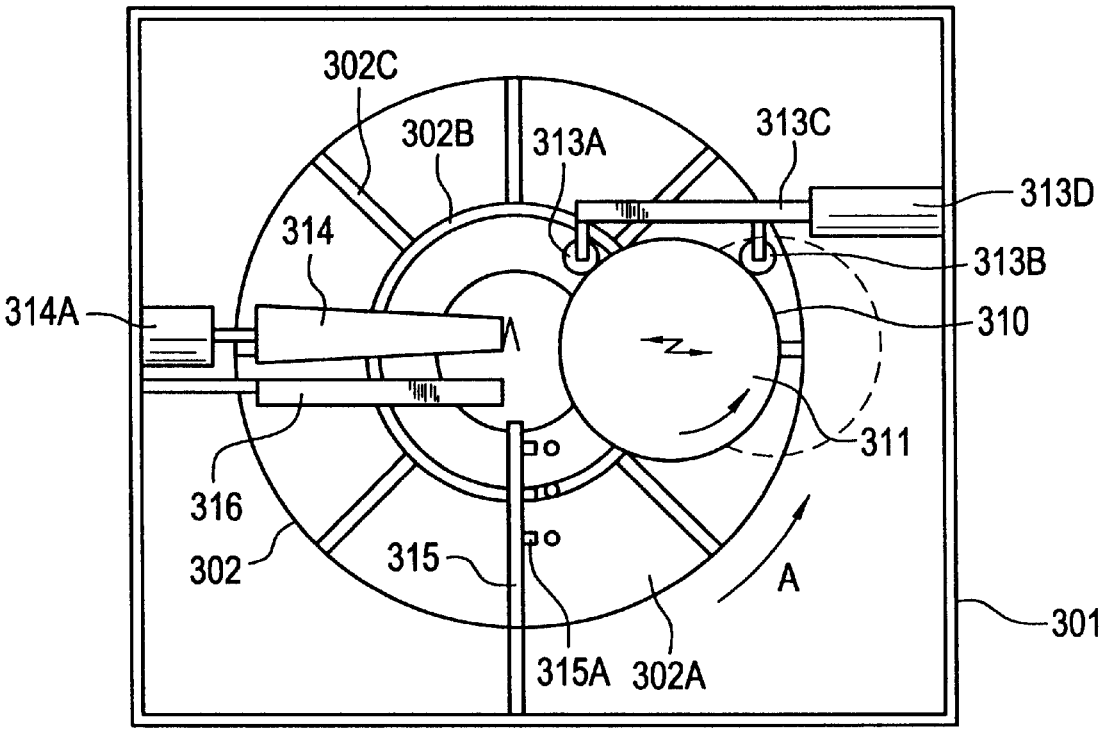
FIG. 8 is a plan view of a surface polishing machine according to a third embodiment of this invention.
Figure 9:
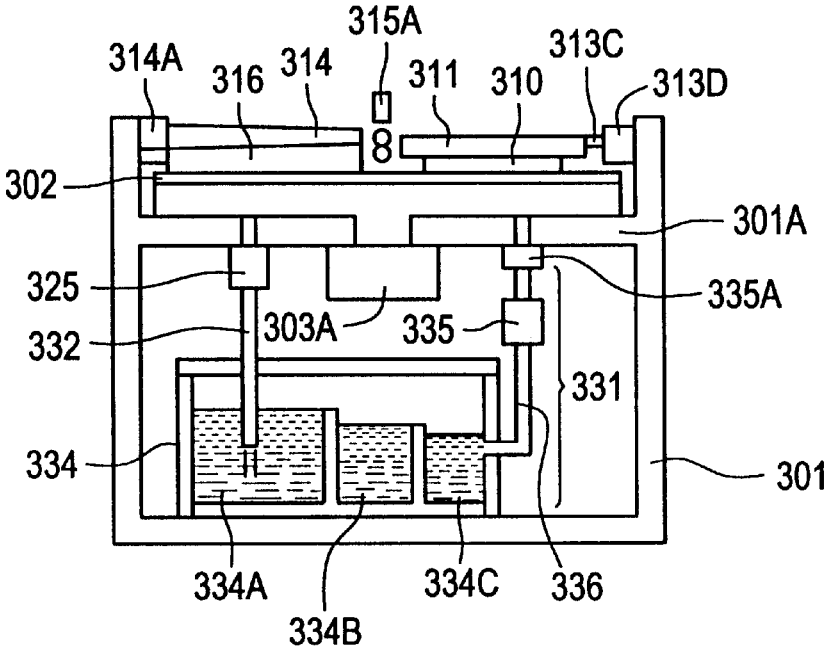
FIG. 9 is a side view of the surface polishing machine shown in FIG. 8.

In FIGS. 8 and 9, a disciform polishing tool 302 having a machining face thereof directed upward is rotatably mounted on an upper frame 301A of a base (housing) 301 of the surface polishing machine, and is adapted to be rotatably driven by a motor 303 in the direction of arrow A (counterclockwise as viewed from above). The polishing tool 302, made of constituent materials containing cashew resin, has a machining face or polishing tool face thereof with which a workpiece 310 is in contact under pressure of a pressurizing holder plate (pressurizing member) 311.

The machining face of the polishing tool 302 is formed with an annular groove 302B coaxially with the center of rotation of the polishing tool 302. The annular groove 302B of this embodiment is comprised of a single recessed groove, which is 1 mm in depth and 10 mm in width, for instance. The radius (radial length) of the groove 302B is equal to the distance between the center of rotation of the polishing tool 302 and that of the workpiece 310 placed thereon, so that the annular groove 302B passes through the center of rotation of the workpiece 310. The polishing tool face of the polishing tool 302 is formed with a plurality of radial grooves 302C spaced from one another circumferentially of the polishing tool. Each radial groove 302C, which is 1 mm in depth and 2 mm in width, for instance, has an inner end thereof communicating with the annular groove 302B, and radially extends toward the outer periphery of the polishing tool 302.

The pressurizing holder plate 311 and the workpiece 310, placed on the machining face of the polishing tool 302, are adapted to rotate around their own axes while being supported by a pair of support rollers 313A, 313B which are in turn supported by a horizontal frame (arm member) 313C located downstream of the workpiece 310 in the direction A of rotation of the polishing tool. The support rollers 313A, 313B are reciprocated by a cylinder 313D to cause the workpiece 310, supported by the rollers, to make a reciprocal motion on the polishing tool 302 in the direction parallel to a radius line (diametral line) of the polishing tool.

The elements 313A–313D serve as a polishing-position retaining mechanism for holding the workpiece 310 at a predetermined polishing position while permitting the workpiece to rotate as the polishing tool 302 rotates, and serve as a swinging mechanism for causing the workpiece 310 to swing on the polishing tool face 302A of the polishing tool over a swing width wider than the entire width of the annular groove 302B.

An abrasive-fluid sucking device 316 is disposed above the machining face of the polishing tool 302 with a slight gap (less than 1 mm). The sucking device 316 is positioned downstream of the workpiece 310 in the direction of rotation of the polishing tool 302. The sucking device 316 is comprised of a parallelopiped box and serves to suck the abrasive fluid on the machining face of the polishing tool 302 from small-diameter holes formed in the bottom face (abrasive-fluid sucking face) of the parallelopiped box, to thereby recover the abrasive fluid. A tapered roller type dresser 314 whose diameter increases toward the outer periphery of the polishing tool 302 extends in parallel to a radius line (diametral line) of the polishing tool 302 and is disposed to be symmetric with the fluid sucking device 316 about the radius line (diametral line) of the polishing tool. The tapered roller type dresser 314 is rotatably driven by a motor 314A while being in contact with the polishing tool 302.

An abrasive-fluid supplying device 315 is provided which comprises nozzles 315A for supplying the abrasive fluid to inner and outer portions and an annular groove portion of the machining face of the polishing tool, these portions being divided by the annular groove 302B from one another. The fluid supplying device 315 is disposed upstream of the workpiece 310 as viewed in the direction of rotation of the polishing tool 302. The dresser 314 is disposed upstream of the workpiece 310 in the rotational direction of the polishing tool 302. The fluid sucking device 316 is positioned between the dresser 314 and the fluid supplying device 315. These devices 315, 316 and the dresser 314 are supported by the base 301. Each of these elements 314–316 has its fluid-supplying region, fluid-sucking region, or dressing region whose length is longer than the radius of the polishing tool 302, so as to cover the entire radial width of the polishing tool face 302A, i.e., the entire length of a line segment joining the center of rotation of the polishing tool and a point on the outer periphery thereof.

The abrasive-fluid sucking device 316 has an abrasive-fluid sucking face thereof facing the polishing tool 302 and formed with abrasive-fluid sucking holes (corresponding to those shown in FIG. 4 and having their diameters in the order of 1 mm, for instance). Those fluid sucking holes formed at each of inner and outer portions of the abrasive-fluid sucking face are about three times greater in number than those formed at a central portion thereof. Further, the abrasive-fluid sucking face has an outer peripheral portion formed with a plurality of shallow grooves (corresponding to those shown in FIG. 4) each having a depth less than 1 mm. The outer peripheral portion of the abrasive-fluid sucking face, at which the abrasive fluid supplying device 315 faces the polishing tool 302, is rounded off (with radius of 2 mm). The dresser 314 is made of a mixture of natural diamond particles (150 micrometers in diameter) and artificial diamond particles (100 micrometers), the mixture being formed into a tapered-roller shape.

As shown in FIG. 9, a regenerative circulating unit 331 (corresponding to the unit 31 shown in FIG. 2) is disposed below the upper frame 301A of the base 301, which unit 331 serves to recycle the abrasive fluid sucked and recovered by the fluid sucking device 316 and supply the same to the fluid supplying device 315. The regenerative circulating unit 331 is comprised of an abrasive fluid bath 334 and a filter 335A. The abrasive fluid bath 334 is provided with multi-stage (three-stage in the illustrated example) sedimentiation baths 334A, 334B, and 334C having settlement and filteration functions of removing foreign particles from the abrasive fluid and having different partition wall height to permit the fluid to overflow from the upstream-most side bath 334A to the intermediate bath 334B and to the downstream-most side bath 334C.

The fluid sucking device 316 is connected to the upstream-most side sedimentiation bath 334A through fluid recovery pipe 332 in which a pump 325 is provided, whereas the fluid supplying device 315 is connected to the downstream-most sedimentiation bath 334C through a fluid supply pipe 336 in which a pump 335 and a filter 335A are disposed. The sucking-side pump 325 has a capacity large enough to suck the abrasive fluid from the fluid sucking device 316 together with air. The supply-side pump 335 has an ability of supplying the abrasive fluid at a flow rate of about 100 CC per minute. The filter 335A is provided with two-stage meshes, having mesh sizes of 50 micrometers and 5 micrometers, respectively, for removing foreign particles that are unremoved in the sedimentiation baths 334A, 334B, and 334C.

In the following, operation of the surface polishing machine of the present embodiment will be explained.

Upon start of machining by means of the polishing tool 302, abrasive fluid is supplied from the fluid supplying device 315 to the polishing tool face 302A. The abrasive fluid supplied to the polishing tool face 302A at a location upstream of the workpiece 310 reaches those portions to be machined of the workpiece as the polishing tool 302 rotates. Due to rotations of the polishing tool and the workpiece, friction occurs therebetween whereby the workpiece is subject to polishing. The annular groove 302B, comprised of a single recessed groove having 1 mm depth and 10 mm width, for instance, is provided at the radial position, corresponding to the center of rotation of the workpiece, of polishing tool. Further, the radial grooves 302C, each having 1mm depth and 2 mm width, for instance, communicate with the annular groove 302B. Thus, the abrasive fluid is supplied from the nozzles 315A to a central portion of the workpiece 310, without causing excessive or insufficient supply of abrasive fluid. Further, elastic deformation of the polishing tool caused by the pressurized contact between the workpiece 310 and the polishing tool 302 is relieved at a location facing the annular groove 302B, so that resultant stress is lessened, to make it possible to reduce the wear and gouge of the polishing tool 302 at its central portion.

As the polishing tool is subjected to dressing by means of the tapered roller type dresser 314 located on the downstream side of the abrasive fluid flow, the abrasive fluid used for the polishing and passing the workpiece is removed from the surface of the polishing tool 302 by the abrasive-fluid sucking device 316. Since the dresser 314, which is a small grindstone, is made of a mixture of natural diamond particles (having a particle size of 150 micrometers) and artificial diamond particles (50 micrometers), an excellent dressing effect is achieved by sharp edges of natural diamond particles and a reduction in costs is achieved by the mixed artificial diamond particles. As a result, chippings of workpiece and polishing tool are stripped off from the polishing tool face 302A of the polishing tool 302, together with the abrasive fluid, and are eliminated in an in-process fashion, whereby a clean polishing tool face 302A is always maintained.

Since the abrasive fluid sucking holes formed at each of inner and outer peripheral portions of the fluid sucking face of the abrasive-fluid sucking device 316 are three times greater in number than those formed at a central portion thereof, the sucking device 316 efficiently sucks the abrasive fluid most of which tends to congregate at the inner and outer radial portions of the polishing tool 302. Moreover, since the shallow grooves each having the depth less than 1 mm are formed in the outer peripheral portion of the abrasive-fluid sucking face, facing the polishing tool, of the fluid sucking device 316, the abrasive fluid receiving a centrifugal force and attempting to flow toward the outer peripheral portion of the polishing tool 302 can be trapped by the shallow grooves, to be efficiently sucked.

Further, since the outer peripheral portion, facing the polishing tool 302, of the fluid sucking face of the fluid sucking device 316 is rounded off, the polishing tool 302 is prevented from being damaged in the unlikely event that the fluid sucking device 316 comes into contact with the polishing tool 302.

As explained above, the abrasive fluid is supplied to a central part of the workpiece without causing excessive or insufficient fluid supply, and the wear and gouge of that portion of the polishing tool which is in contact with the central part of the workpiece are reduced. Thus, an inner radial portion of the workpiece can be machined as with the case of an outer peripheral portion thereof, so that a uniform polishing can be achieved even if the workpiece is large in diameter. Moreover, since the abrasive fluid is supplied over the entire radial width of the polishing tool face 302A of the polishing tool 302 (corresponding to the entire length of a line segment joining the center of rotation of the polishing tool and a point on the outer periphery thereof) and is recovered therefrom, the polishing can be carried out in the same condition, irrespective of the size of the workpiece 310.

The following are results of an experiment in respect of the polishing machine of the third embodiment of FIGS. 8 and 9.

The experiment was carried out in the same conditions in respect of wafer, abrasive fluid, tool rotational speed, wafer-pressurizing pressure, wafer swinging width as those for the first embodiment, except that a disciform polishing tool having a 30 in. diameter was used in place of an annular polishing tool having a 480 mm outer diameter and a 120 mm inner diameter. The evenness of ±3% was obtained when the polishing of a 12 in. wafer was made with a polishing amount of 15000±500 angstroms.

This experimental result indicates that highly accurate polishing on such a large diameter wafer can be carried out with use of the polishing machine of this embodiment which is compact in size and in which the fluid can be supplied, without causing excessive or insufficient supply of abrasive fluid, to a central part of the workpiece through the annular groove, furthermore, chippings produced during the polishing can be discharged through the annular and radial grooves, and elastic deformation of the polishing tool caused by the pressurized contact between the workpiece and the polishing tool can be relieved by the annular groove to thereby reduce the wear and gouge of the polishing tool at its central portion.

Figure 10:
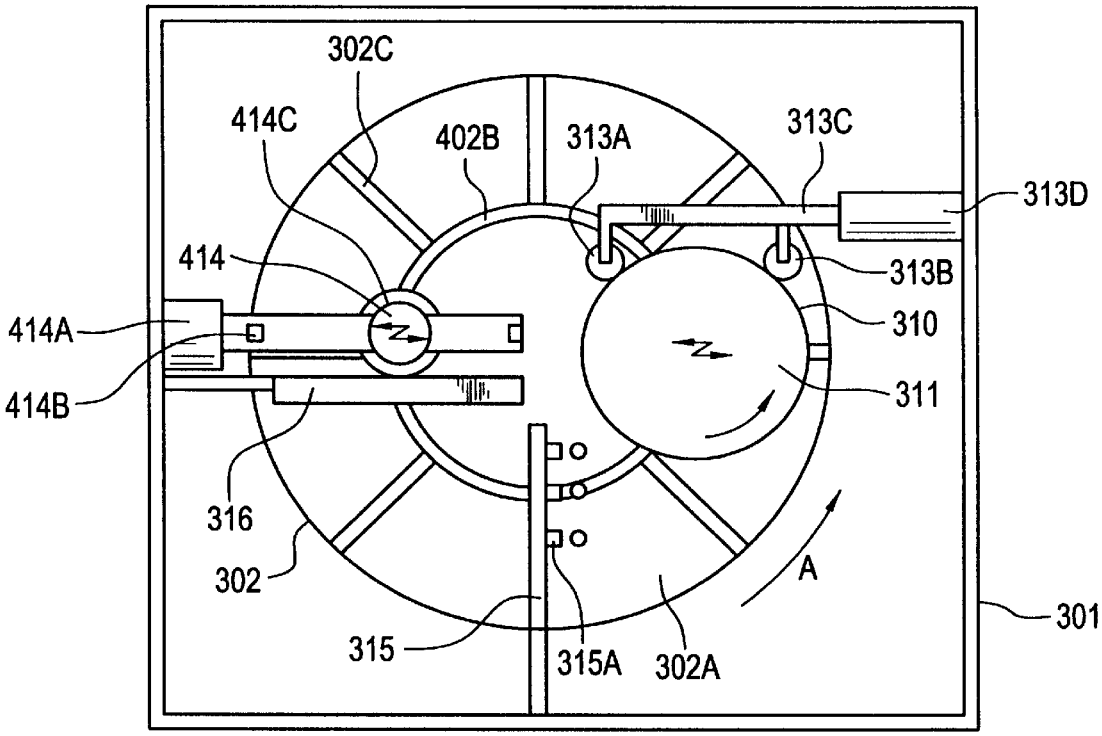
FIG. 10 PRIOR ART
FIG. 10 is a plan view of a surface polishing machine according to a fourth embodiment of this invention.
Figure 11:
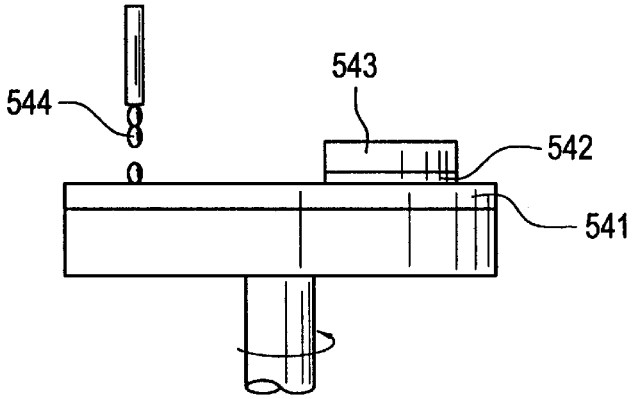
FIG. 11 PRIOR ART
FIG. 11 is a side view exemplarily showing a conventional surface polishing machine.
Figure 12:
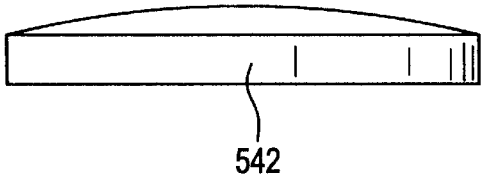
FIG. 12 PRIOR ART
FIG. 12 is a view showing a cross sectional shape of a workpiece having been subject to the polishing by means of the conventional polishing machine shown in FIG. 11.

Next, a surface polishing machine according to a fourth embodiment of the present invention will be explained with reference to FIG. 10 in which elements common to FIGS. 8, 9 and FIG. 10 are denoted by like numerals and explanations of these elements will be omitted.

In the surface polishing machine of the fourth embodiment, an annular groove 402B comprised of a group of recessed grooves is provided, in place of the annular groove 302B comprised of a single recessed groove in the third embodiment. The annular groove 402B is formed in the polishing tool face 302A of the disk-shaped polishing tool 302 coaxially with the polishing tool in a manner passing through the center of rotation of a workpiece 310 placed on the polishing tool. The group of recessed grooves, each having e.g. a 1 mm depth, are spaced from one another with e.g. a 2 mm pitch in the radial direction of the polishing tool, to constitute the annular groove 402B which is 10 mm in width. The annular groove 402B communicates with radial grooves 302C formed in the polishing tool face 302A.

In the embodiment, a small disciform dresser 441C is provided in place of the taper roller type dresser 314 for the third embodiment. The dresser 441C, serving to dress the polishing tool face 302A, is disposed on the downstream side as viewed in the direction of flow of abrasive fluid on the polishing tool face, and is arranged to be reciprocated on the polishing tool face by means of a reciprocating mechanism which is similar in construction to the reciprocal motion mechanism shown in FIG. 5. The reciprocating mechanism includes a motor 414A mounted to an arm member together with the dresser 414C, and is arranged to rotate the motor 414A forwardly and reversely in response to signals delivered from micro-switches 414B disposed at reciprocal motion limits of the dresser 414C, thereby reciprocating the dresser.

In other respects, the surface polishing machine of this embodiment is the same in construction as the third embodiment, and accordingly achieves functions and advantages similar to those achieved by the third embodiment.

In respect of the surface polishing machine of the fourth embodiment, an experiment was carried out in substantially the same conditions as those for the third embodiment. The evenness of ±4% was obtained when the polishing of a 12 in. wafer was made with a polishing amount of 15000±600 angstroms. This indicates that the polishing machine of this embodiment can eliminate a problem of unevenness observed when the polishing is made on a large diameter wafer with use of a conventional polishing machine.

The present invention is not limited to the first through fourth embodiments, and can be modified in various manners.

For instance, in the foregoing embodiments, a raised wall may be provided along the peripheral edge portion of the polishing tool, so as to prevent the abrasive fluid from flowing out of the polishing tool face. The raised wall makes it possible to improve the fluid recovering efficiency and to reduce running costs of the polishing machine.

Although surface polishing on a 12 in. wafer has been described in the embodiments, the present invention is applicable to a surface polishing machine for use with a 6, 8, or 14 in. wafer. The polishing machine of this modification is also compact in size.

A disciform workpiece comprised of a wafer with silicon dioxide film has been explained in the embodiments, however, the workpiece may be a wafer formed with metallic lines, a magnetic disk, a glass substrate, or the like.

Although the polishing tool having a polishing tool face thereof arranged in a horizontal position has been explained in the embodiments, the polishing tool face may be directed vertically or slantly.

What is claimed is:

1. A surface polishing machine, comprising:

a polishing tool having an annular polishing tool face and adapted to be rotatively driven for polishing a workpiece placed on said polishing tool face, said workpiece having a predetermined circumcircle diameter, wherein an outer diameter of said polishing tool is larger than said circumcircle diameter of said workpiece and smaller than twice the circumcircle diameter of the workpiece;

a disciform pressurizing member, placed on and movable in unison with the workpiece placed on said annular polishing tool face, for uniformly placing pressure on the workpiece such that said workpiece is pressed against the annular polishing tool face of said polishing tool; and a polishing-position retaining mechanism for holding the workpiece and said disciform pressurizing member at a predetermined polishing position on the annular polishing tool face, while permitting said workpiece and said disciform pressurizing member to rotate about a center of rotation in said polishing-position.

2. The surface polishing machine according to claim 1, wherein said polishing-position retaining mechanism is adjustable controlled for variably setting said center of rotation at an arbitrary position on the annular polishing tool face of said polishing tool and for retaining said center of rotation at said arbitrary position.

3. The surface polishing machine according to claim 1, wherein said polishing-position retaining mechanism is adjustably controlled and has a workpiece-centroid-position setting for positioning a centroid portion of the workpiece to be coincident with a center position of an area in which said annular polishing tool face is in contact with the workpiece.

4. The surface polishing machine according to claim 1, further comprising:

a disciform dresser disposed contactingly above the annular polishing tool face of said polishing tool at a location downstream from the workpicce as viewed in a rotational direction of said polishing tool, said disciform dresser having a diameter larger than a radial width of the annular polishing tool face, said disciform dresser for dressing the annular polishing tool face.

5. The surface polishing machine according to claim 1, further comprising:

an abrasive-fluid supplying mechanism disposed above the annular polishing tool face of said polishing tool at a predetermined distance therefrom and disposed upstream from the workpiece in a rotational direction of said polishing tool, said abrasive-fluid supplying mechanism having a plurality of fluid jet nozzles for supplying abrasive fluid to the annular polishing tool face of said polishing tool; and an abrasive-fluid sucking mechanism, disposed above the annular polishing tool face of said polishing tool at a location downstream from the workpiece in the rotational direction of said polishing tool, said abrasive-fluid sucking mechanism for sucking and collecting used abrasive fluid from the annular polishing tool face.

6. The surface polishing machine according to claim 4, further comprising:

an abrasive-fluid supplying mechanism, disposed above the annular polishing tool face of said polishing tool at a location upstream of the workpiece in the rotational direction of said polishing tool, for supplying abrasive fluid to the annular polishing tool face of said polishing tool; and an abrasive-fluid sucking mechanism, disposed above the annular polishing tool face of said polishing tool at a location downstream of said disciform dresser in the rotational direction of said polishing tool, for sucking and collecting used abrasive fluid from the annular polishing tool face.

7. The surface polishing machine according to claim 5, wherein said abrasive-fluid sucking mechanism extends in a radial direction of the annular polishing tool face of said polishing tool, said abrasive-fluid sucking mechanism having an abrasive-fluid sucking face thereof, said abrasive-fluid sucking face facing the annular polishing tool face of said polishing tool and formed with a plurality of abrasive-fluid sucking holes, a maiority of which are formed in regions of the abrasive-fluid sucking face corresponding to inner and outer radial portions of said annular polishing tool face.

8. The surface polishing machine according to claim 5, wherein the abrasive-fluid sucking face of said abrasive-fluid sucking mechanism has two longitudinal side portions thereof provided with a plurality of sucking shallow grooves for communicating with outside air near said annular polishing tool face.

9. The surface polishing machine according to claim 5, further comprising:

an abrasive-fluid collecting bath having a U-shaped cross section, said abrasive-fluid collecting bath surrounding a bottom and an outer periphery of and adapted to rotate in unison with said polishing tool; and an abrasive-fluid recovering mechanism, disposed in said abrasive-fluid collecting bath, for sucking and removing the abrasive fluid collected in said abrasive-fluid collecting bath.

10. The surface polishing machine according to claim 5, further comprising:

a regenerative circulating unit for recycling abrasive fluid sucked and recovered by said abrasive-fluid sucking mechanism and for delivering recycled abrasive fluid to said abrasive-fluid supplying mechanism.

11. A surface polishing machine, comprising:

a polishing tool for polishing a workpiece with a predetermined circumcircle diameter and adapted to be rotatively driven, said polishing tool having a polishing tool face formed with an annular groove positioned coaxially with a center of rotation of said polishing tool, said polishing tool having a radius smaller than the circumcircle diameter of said workpiece;

a pressurizing member for providing pressure between the workpiece and the polishing tool face of said polishing tool, said pressuring member disposed on top of said workpiece;

a polishing-position retaining mechanism for holding the workpiece at a predetermined polishing position, while permitting the workpiece to rotate about an axis of rotation offset from said center of rotation of said polishing tool, wherein said annular groove passes through the workpiece axis of rotation when the workpiece is placed on the polishing tool face of said polishing tool; and an abrasive-fluid supplying mechanism for supplying abrasive fluid to the polishing tool face of said polishing tool.

12. The surface polishing machine according to claim 11, wherein the annular groove formed in the polishing tool face of said polishing tool is comprised of one of a single recessed groove and a group of a plurality of recessed grooves spaced from one another with a small pitch in a radial direction of said polishing tool.

13. The surface polishing machine according to claim 11, wherein the polishing tool face of said polishing tool is formed with at least one radial groove extending radially toward an outer periphery of said polishing tool, originating from and communicating with said annular groove formed in the polishing tool face.

14. The surface polishing machine according to claim 11, further comprising:

a swinging mechanism for causing the workpiece to swing on the polishing tool face of said polishing tool over a swing width wider than a width of said annular groove.

15. The surface polishing machine according to claim 11, wherein the polishing tool face of said polishing tool is divided into an inner radial portion, an outer peripheral portion, and a middle, annular groove portion, and wherein said abrasive-fluid supplying device includes a plurality of nozzles for supplying abrasive fluid to the inner radial portion, the outer peripheral portion, and the middle, annular groove portion of the polishing tool face, respectively.

16. The surface polishing machine according to claim 11, wherein said polishing tool is made of constituent materials containing a cashew resin.

17. The surface polishing machine according to claim 11, further comprising:

a dresser disposed on the polishing tool face of said polishing tool, said dresser having a dressing region overlapping a radial width of the polishing tool face, wherein the dresser comprises one of a tapered-roller type dresser with a diameter that increases toward an outer periphery of said polishing tool and a disciform dresser.

18. The surface polishing machine according to claim 17, further comprising:

an abrasive-fluid sucking mechanism disposed above said polishing tool face and located between said dresser and said abrasive-fluid supply mechanism, wherein said abrasive-fluid sucking mechanism includes a sucking region having a length which is longer than the radial width of the polishing tool face.

19. The surface polishing machine according to claim 17, wherein said dresser is the disciform dresser, and said disciform dresser having a diameter smaller than the radial width of said polishing tool face, wherein said disciform dresser is adapted to reciprocate between an inner and an outer edge of the radial width of said polishing tool face.

* * * * *